US008407918B2

(12) United States Patent
Gschwender

(10) Patent No.: US 8,407,918 B2
(45) Date of Patent: Apr. 2, 2013

(54) SHOE

(75) Inventor: Herbert Gschwender, Alcabideche (PT)

(73) Assignee: Bodyfeel-Produtos de Saude Ltd, Alcabideche (PT)

( * ) Notice: Subject to any disclaimer, the term of this patent is extended or adjusted under 35 U.S.C. 154(b) by 267 days.

(21) Appl. No.: 12/312,687

(22) PCT Filed: Dec. 14, 2007

(86) PCT No.: PCT/EP2007/011022

§ 371 (c)(1), (2), (4) Date: May 21, 2009

(87) PCT Pub. No.: WO2008/071443

PCT Pub. Date: Jun. 19, 2008

(65) Prior Publication Data

US 2010/0058614 A1 Mar. 11, 2010

(30) Foreign Application Priority Data

Dec. 14, 2006 (DE) ..... 10 2006 059 493

(51) Int. Cl.
*A43B 13/18* (2006.01)

(52) U.S. Cl. ..... 36/28; 36/43; 36/25 R

(58) Field of Classification Search ..... 36/43, 44, 36/71, 28, 25 R, 30 R, 35 R
See application file for complete search history.

(56) References Cited

U.S. PATENT DOCUMENTS 930,990 A * 8/1909 Rogers ..... 36/35 R
1,529,526 A * 3/1925 Winter ..... 36/35 R
1,907,136 A * 5/1933 Weitsen ..... 36/145
(Continued)

FOREIGN PATENT DOCUMENTS

CH 673 377 3/1990
DE 297 17 559 11/1997
(Continued)

OTHER PUBLICATIONS

International Search Report, Mar. 28, 2008.
(Continued)

*Primary Examiner* — Darnell Jayne
*Assistant Examiner* — Devin Barnett
(74) *Attorney, Agent, or Firm* — Collard & Roe, P.C.

(57) ABSTRACT

A first thin insole (2) having an arch insole (2*a*) configured with a recess (2*b*) in the metatarsal region (1*b*) is provided on the sole body (1) of a shoe, which extends from the heel region (1*a*) across the metatarsal region (1*b*) to the front ball/toe region (1*c*). A foam insert (3), which has a cutout (3*a*) corresponding to the size of the arch insole (2*a*), is disposed on the first insole (2), the insert extending from the heel region (1*a*) to the front ball/toe region (1*c*). A second insole (4) in the form of a support, which has a spherical segment-shaped or ellipsoid segment-shaped hollow body (4*c*), which protrudes in the metatarsal region (1*b*) from the bottom of the insole (4) and is adapted to the arch insole recess (2*b*), is provided on the foam insert (3). Such a shoe configured according to the invention can achieve a physiologically effective and correct rolling motion (flexing motion) by the placement of the sole body in the back heel region, and subsequent rolling off via the physiological guide body in the form of the hollow body (4*c*), toward the front ball/toe region (1*c*), particularly in the direction of the big toe.

11 Claims, 3 Drawing Sheets

U.S. PATENT DOCUMENTS

| | | | | |
|---|---|---|---|---|
| 2,482,333 | A * | 9/1949 | Everston | 36/43 |
| 3,087,265 | A * | 4/1963 | McKinley | 36/35 R |
| 4,133,118 | A * | 1/1979 | Khalsa et al. | 36/83 |
| 4,408,402 | A * | 10/1983 | Looney | 36/43 |
| 5,054,753 | A * | 10/1991 | Polus | 267/153 |
| 5,086,574 | A * | 2/1992 | Bacchiocchi | 36/35 R |
| 5,092,060 | A * | 3/1992 | Frachey et al. | 36/29 |
| 5,224,277 | A * | 7/1993 | Sang Do | 36/27 |
| 5,802,743 | A | 9/1998 | Chien | |
| 5,881,478 | A | 3/1999 | McMahon et al. | |
| 5,915,820 | A * | 6/1999 | Kraeuter et al. | 36/114 |
| 6,205,684 | B1 * | 3/2001 | Snyder | 36/35 R |
| 6,247,250 | B1 * | 6/2001 | Hauser | 36/44 |
| 6,301,807 | B1 * | 10/2001 | Gardiner | 36/155 |
| 6,341,432 | B1 | 1/2002 | Muller | |
| 6,460,273 | B2 * | 10/2002 | Witjes | 36/71.5 |
| 6,754,982 | B2 * | 6/2004 | Reed et al. | 36/30 A |
| 6,789,332 | B1 * | 9/2004 | Scholz | 36/27 |
| 2003/0140523 | A1 * | 7/2003 | Issler | 36/37 |
| 2007/0151124 | A1 * | 7/2007 | Chan | 36/35 R |
| 2008/0250673 | A1 * | 10/2008 | Andrews et al. | 36/25 R |
| 2009/0031584 | A1 * | 2/2009 | Rasmussen et al. | 36/88 |
| 2009/0083995 | A1 * | 4/2009 | Hsieh et al. | 36/29 |
| 2011/0056092 | A1 * | 3/2011 | Tsiantos | 36/103 |

FOREIGN PATENT DOCUMENTS

| | | |
|---|---|---|
| EP | 0 999 764 | 5/2000 |
| EP | 1 702 593 | 9/2006 |
| WO | WO 2006/107823 | 10/2006 |

OTHER PUBLICATIONS

English translation of the Written Communication by the International Searching Authority, May 21, 2009.
International Search Report dated Mar. 28, 2008.
English translation of the Written Communication by the International Searching Authority dated May 21, 2009.

* cited by examiner

SHOE

CROSS REFERENCE TO RELATED APPLICATIONS

This application is the National Stage of PCT/EP2007/011022 filed on Dec. 14, 2007, which claims priority under 35 U.S.C. §119 of German Application No. 10 2006 059 493.2 filed on Dec. 14, 2006. The international application under PCT article 21(2) was not published in English.

The invention relates to a shoe comprising a sole body extending from the heel region to the front ball/toe region via the metatarsal region, and upper fastened to the sole body.

BACKGROUND ART

EP 999 764 describes a shoe with a sole extending from the heel region to the ball/toe region, the sole being formed by a sole body and a sole covering arranged on the underside of the sole body. Further, a recess extending from near the metatarsal region to the heel region is provided between the sole body and the sole covering. The portion of the sole region related to the recess forms a pivot element adapted for pivotal movement about an axis located in the end portion of the recess that is directed to the metatarsal region. The recess contains at least one approximately wedge-shaped or segment-shaped material element of a resilient, soft material. The pivotable sole covering is flexible in the region of the pivot axis and/or is tapered in this region.

The known shoe has proven disadvantageous in that due to the repeated pivotal movement of a part of the sole covering about the axis, the wear and tear are relatively great in the metatarsal region, which consequently is a weak point of this shoe. Besides, this is no wonder, since this very region, where the pivot axis of the sole covering is located, is exposed to particularly great stresses at each step. Every step, the sole covering is first put down in the heel region; then, the shoe is rolled off in and through the metatarsal region which takes place especially in the region of the pivot axis of the flexible sole portion In an embodiment of the known shoe, the approximately wedge-shaped, lens-shaped or approximately segment-shaped recess is filled with resilient foam material which effects a relief of the foot and/or knee joint. The foam material becomes brittle over time due to the constant high stress it is exposed to, it becomes sensitive to mechanic influences and absorbs any kind of liquid, with the consequence that this foam material has to be removed and replaced with new damping material in a time-consuming operation.

SUMMARY OF THE INVENTION

Therefore, it is an object of the invention to configure a shoe such that impact stresses occurring in walking/running are not, or only to a very limited extent, transmitted to the knees, the hip joints and the vertebral column, and that, at the same time, a physiologically correct rolling motion is achieved.

According to the invention, this object is achieved with the features mentioned in the characterizing part of claims 1, 11 and 12. Advantageous embodiments are the subject matter of dependent claims.

According to invention, the object is achieved for a shoe defined in the precharacterizing part of claim 1 by providing, arranged one on top of the other on the sole body, a first thin insole with an arch insole formed in the metatarsal region and having a recess, a foam insert extending continuously from the heel region to the front ball/toe region and having a cutout corresponding to the size of the arch insole, and a second insole in the form of a footbed with a spherical segment-shaped or ellipsoid segment-shaped hollow body that projects from the underside of the second insole in the metatarsal region and is adapted to the recess of the arch insole.

With a shoe embodied according to the invention, provided with both insoles and the foam insert sandwiched therebetween, a physiologically correct rolling motion is thus performed such that a rolling motion in the form of a flexing motion is performed beginning, for example, on the outer side of the foot in the rear heel region via the metatarsal region to the ball region and the big toe. As such, the sensitive foam insert between the two insoles is protected not only against mechanical influences, but also against humidity. The wearer of a shoe thus designed will perceive the outside of the shoe as being of a common appearance. This makes the wearer of this shoe feel safe. Nobody can tell that the wearer of a shoe embodied according to the invention is wearing a so-called "balance" shoe.

Because of the functioning described above, the impact stress on the sensitive foot and knee joints, as well as on the vertebral column is drastically reduced during walking and standing. Further, a wearer of a shoe embodied according to the invention is caused to take a basic physiological posture in which the knees are slightly angled. Besides the knees, this relieves the vertebral column when standing; at the same time, the body posture of the upper part of the wearer's body is improved. This is achieved by the physiologically correct posture assumed while walking and standing, since the muscles are thereby reactivated in a natural manner and thus relieve the joints, acting as a kind of natural shock absorber.

According to an advantageous embodiment of the invention, in order to promote a sinking in in the heel region, the foam insert has a deep recess in the underside in the heel region. In addition, the invention also provides a shallow recess in the underside of the front ball/toe region, so that the correct physiological rolling motion is additionally supported by the two recesses in the underside of the foam insert.

This is caused by the fact that, different from other shoes, the heel region sinks in a lot when setting on the ground, often hard asphalt; thereby, the knee is angled slightly, the upper part of the body is straightened and the muscles are activated, before an impact-type load acts on the body upon setting a foot on the ground. Thus, the muscles absorb a major part of the impact stress, whereby the joints are relieved considerably. After sinking in in the heel region, the foot then rolls off softly via the metatarsal region.

Here, the two insoles of wear-resistant, abrasion-resistant material, such as carbon fiber reinforced material, hard plastics, hard rubber, metal or a similar material with corresponding properties, and the foam insert sandwiched therebetween effect a distribution of the pressure load over the entire foot region. The load on the foot and on the joints materializes only after the sinking in in the heel region, during the rolling process.

Further positive effects of the changed gait and the changed posture while standing and walking are the following:

With flatfeet, skew feet and fallen arches or strong pronation, a "stimulus" is imparted upon every step, primarily in the region of the plantar aponeuroses (strands of longitudinal fibers). This, in turn, may cause the arch to rise again in cases of pronounced pronation or flatfeet.

Moreover, all muscles around the foot joint and the foot flexors are trained thereby; this, in turn, has as its consequence that the perfusion of the venous muscles is guaranteed which is of importance especially with respect to varicose veins, for example. Even the lymph flow is stimulated by the rocking movement in the shoe and the excretion of waste products is enhanced.

To avoid the exertion of pressure on the metatarsus in the area of the arch insole and the spherical segment-shaped or ellipsoid segment shaped hollow body, a damping element, e.g. in the form of foam material, is provided in the hollow body. To secure the damping foam material in the hollow body, the upper surface of the second insole is provided with a thin covering of leather or a material similar to leather.

To support and promote the physiologically correct rolling motion, an advantageous development of the invention provides, on the one hand, that at least one slit is formed in the heel region of the second insole, the slit starting from the outer edge thereof extending forward under an acute angle to the longitudinal axis of the shoe, and, on the other hand, that at least one slit is made in the ball/toe region of the second insole, starting from the outer edge of the sole towards the front under an acute angle to the longitudinal axis of the shoe, and at least two slits starting from the inner edge of the sole toward the rear under an acute angle to the longitudinal axis of the shoe. Together with the bowl-like design of the second insole, these slits achieve some type of guiding, whereby the physiological effect is further promoted.

The above mentioned embodiments of the shoe advantageous with respect to a physiologically correct rolling motion in the manner of a flexing motion apply in particular to walking shoes. To achieve an adaptation to shoes used in sports, the second insole may be designed such that it is raised in the heel region as a spherical heel.

The above described measures and developments of the shoe according to the invention may also be realized if the designs of the first thin insole and the second insole are switched, respectively. In this case, a spherical segment-shaped or an ellipsoid segment-shaped hollow body is integrated in the first thin insole placed on top of the sole body of the shoe, the hollow body protruding from the sole upper surface in the metatarsal region, whereas the second insole in the form of a footbed has the arch insole integrated therein, which protrudes from the sole underside in the metatarsal region, which arch insole, in turn, has a recess corresponding to the spherical segment-shaped or the ellipsoid segment-shaped hollow body.

In another embodiment of the shoe according to the invention, the first thin insole comprises an arch insole integrated in the metatarsal region, having a frustoconical recess therein. Accordingly, the second insole designed as a footbed comprises a hollow body protruding from the underside of said sole and corresponding to the recess in the footbed, wherein, in said hollow body, a frustoconical section passes into a spherical segment-shaped section.

With arthrosis of the knees and other forms of problems of the joints, the above described embodiments of the shoes of the invention provide enormous relief if only by changing the statics. A wearer of a shoe designed according to the invention stands more erect and walks and stands more at the "centre"; in turn, this is of great importance for defective positions such as bowlegs (genu varum) or cross-legs (genu valgum).

This effect is further promoted by the fact that the shoe of the invention is also stable in the lateral direction ("balance" effect"). As a consequence, the wearer/user of this shoe additionally trains (or has to train) the foot muscles, whereby a tendency to pronation or supination is prevented.

The active walking and the physiologically correct rolling motion achieved thereby, muscles, such as the musculus gluteus maximus, medius and minimus, are activated a lot more, which is of particular importance for the support of the muscles of the lower back and for the stabilization of the pelvis. The spiral dynamics propagating upwards from the foot trains the entire trunk again.

The back muscles are included in the walking motion again, just as the abdominal muscles are. In a sense of speaking, one changes from passive to active walking. The person again learns conscious walking, also including the Natural active pendulum motion of the arms, whereby the shoulders and the upper back muscles are activated; hardenings are released.

DESCRIPTION OF THE INVENTION

Figure 1:
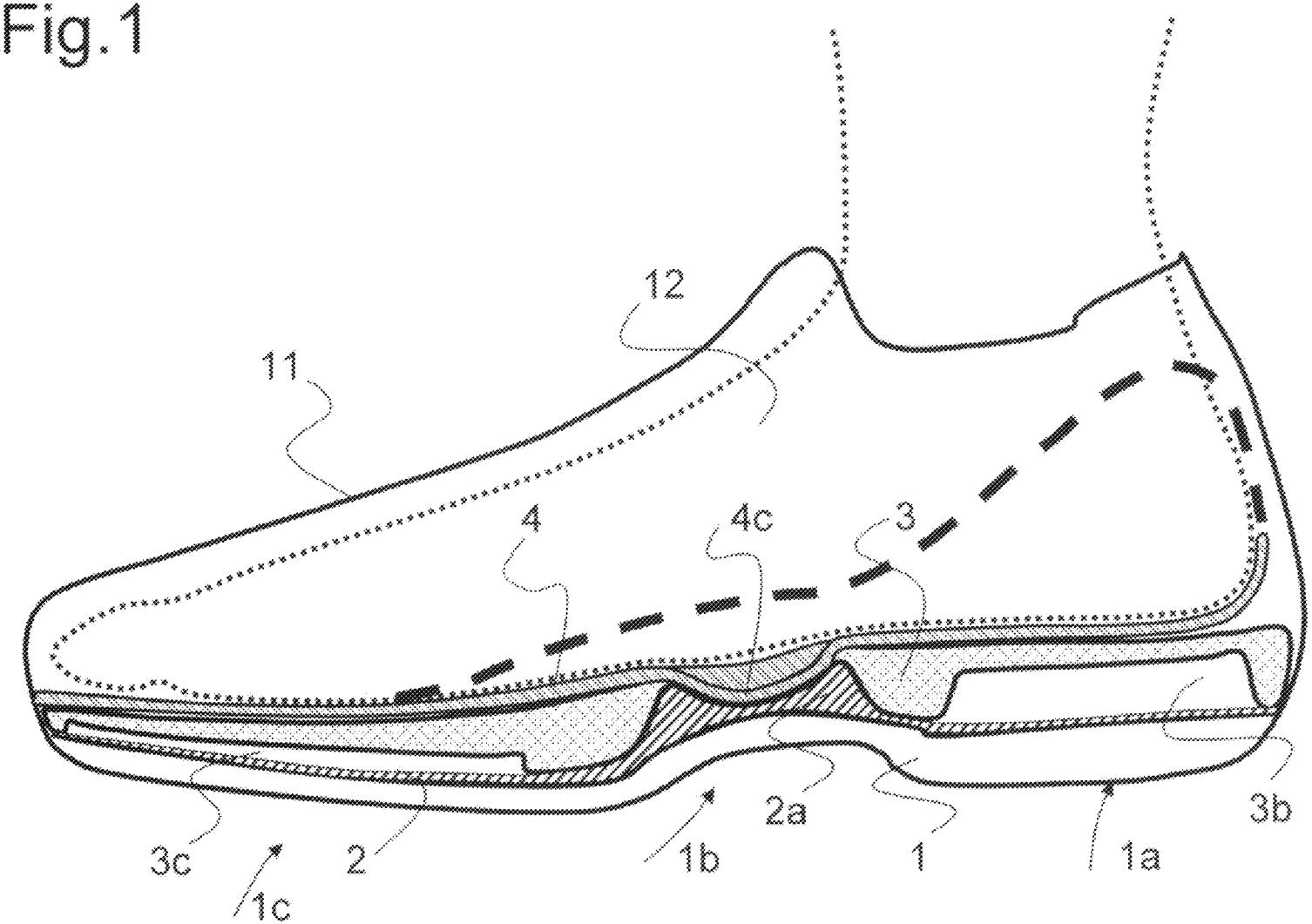
FIG. 1 is a schematic longitudinal section through an embodiment of a shoe and its sole region with the upper indicated.

In FIG. 1 to FIG. 5, identical or similar parts of the shoe of the invention are identified by the same reference numerals. The shoe of the present invention comprises a continuous sole body 1 and upper 11 connected therewith, which encloses a foot 12 of a wearer that is represented in broken lines only in FIG. 1. The upper 11 may be closed in a usual manner, for example, by means of laces, Velcro-type fasteners, or the like. The sole body 1 extends from a rear heel region 1*a* via a contiguous metatarsal region 1*b* to a front ball toe region 1*c*; each of these three regions 1*a* to 1*c* extends over approximately one third of the shoe's length.

A sole covering, not illustrated in detail in the Figures, is provided on the underside of the sole body, which covering is made from an abrasion-resistant material, such as hard rubber, for example, and may be profiled on its underside.

On the sole body 1, a first thin insole 2 is arranged with an arch insole 2*a* integrated therein in the metatarsal region 1*b*, in which a recess 2*b* is formed that corresponds to the shape of a hollow body that will be described in detail hereunder. (Also see FIG. 3)

Figure 2:
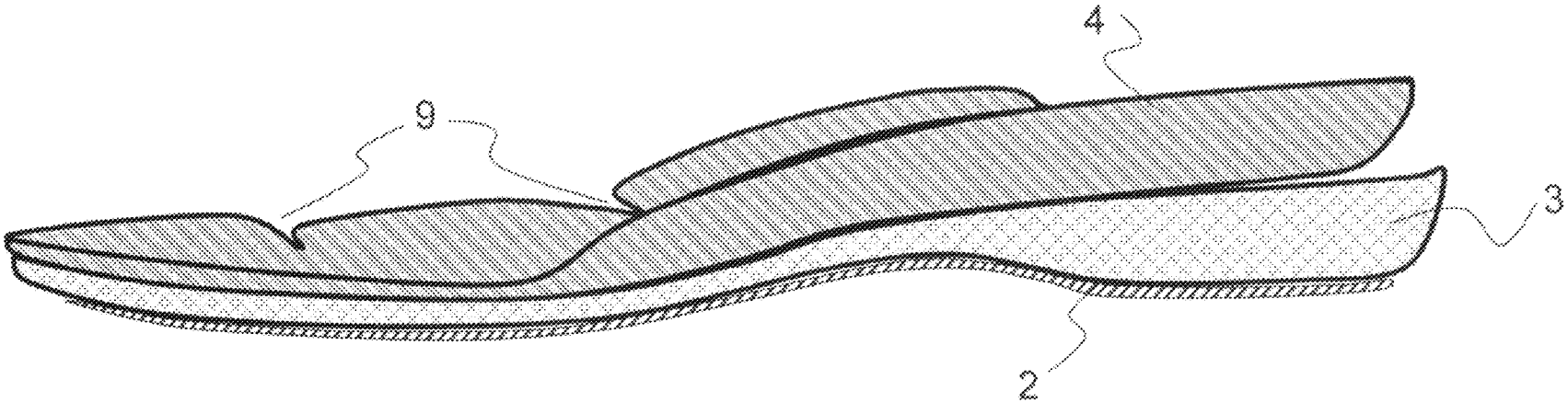
FIG. 2 is a schematic side elevational view of two insoles with an insert sandwiched therebetween.
Figure 4:
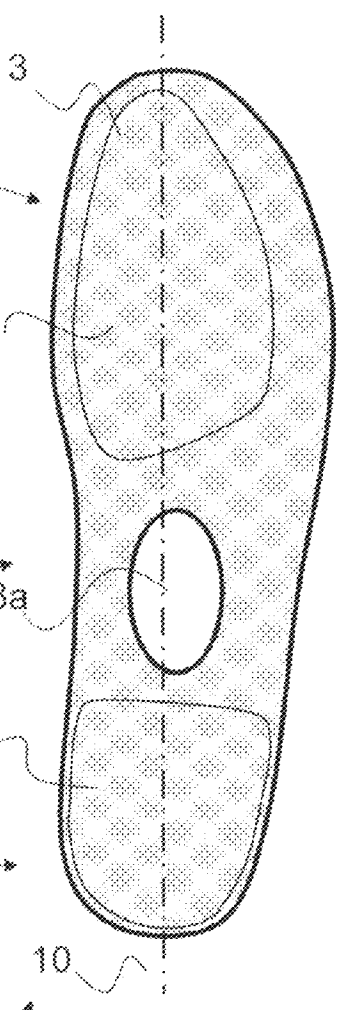
FIG. 4 also in schematic top plan view, illustrates the underside of the insert sandwiched between the insoles, and FIG. 5 again in schematic top plan view, illustrates a second insole.
Figure 3:
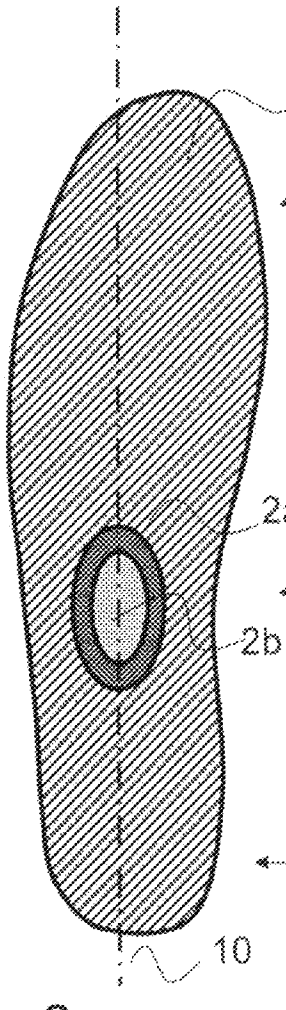
FIG. 3 is a schematic top plan view of a first insole.

As is obvious from FIGS. 1 and 2, a foam insert 3 is provided on the first thin insole 2, which insert extends continuously from the heel region 1*a* to the ball/toe region 1*c* via the metatarsal region 1*b*. As can be seen in FIGS. 1 and 4, a cutout 3*a* is provided that corresponds in size to the arch insole 2*a* integrated in the first insole 2.

The foam insert 3 is made from a resilient material and, as can be seen in the sectional view in FIG. 1 and the illustration in FIG. 4, has a deep recess 3*b* in the underside of the heel region 1*a*, as well as a further, relatively shallow recess 3*c* in the front ball/toe region 1*c*.

As is also visible in FIGS. 1 and 2, a second insole 4 is placed on the foam insert 3, which insole is designed in the manner of a footbed. Integrated in the second insole 4 is a ellipsoid segment-shaped hollow body 4*c* protruding from the underside of the insole 4 and formed in the metatarsal region 1*c*, the recess 2*b* in the arch insole 2*a* being adapted to the shape of this hollow body. The hollow body 4*c* may also be spherical segment-shaped, such as hemispherical or similar.

Both the first thin insole 2, as well as the somewhat thicker second insole 4 are made from a wear-resistant, abrasion-resistant material, such as carbon fiber reinforced material, hard plastics elastic to a certain degree or elastic hard rubber, an elastically deformable metal, ort a similar material with corresponding properties.

The second insole 4 represented in section (FIG. 1) and in side elevation (FIG. 2) is intended in particular for walking shoes. Different from this, the embodiment of the second insole 4 indicated in FIG. 1 by a thick broken line is intended especially for sports shoes. For this reason, the rear part of the second insole 4 is formed corresponding to the spherical heel of the human foot and is raised accordingly.

Figure 5:
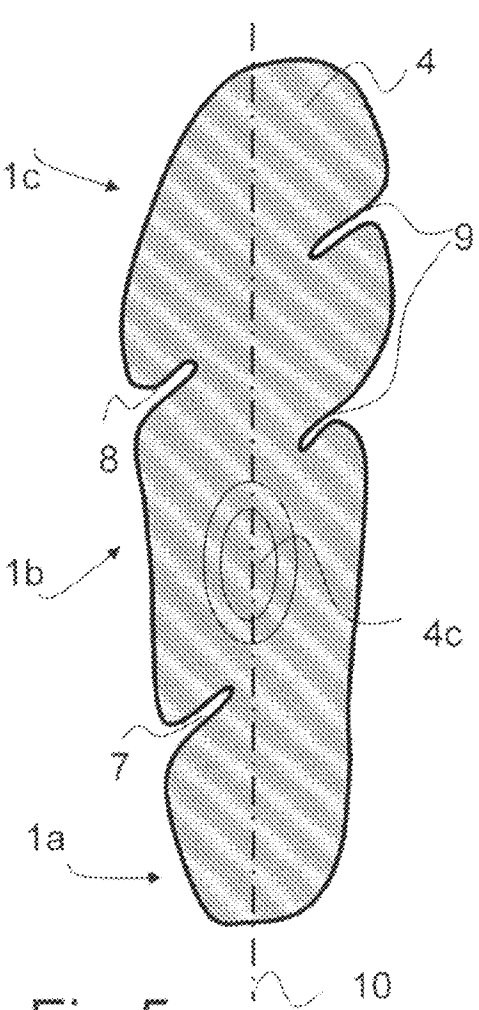

As is visible from the elevation in FIG. 2 and in particular from the top plan view in FIG. 5, the second insole 4 is provided with at least one slit 7 in the heel region 1*a* and slits 8 and 9 in the ball/toe region 1*c*. As is evident from FIG. 5, the slit 7 extends frontward from the outer edge of the sole in the heel region 1*a*, i.e. towards the metatarsal region 1*b* and under an acute angle to the longitudinal axis 10 of the shoe indicated as a chain-dotted line. The slit 8 extends frontward from the outer edge of the sole in the ball region 1*c* of the second insole 4, directed towards the toe region, also running under an acute angle to the longitudinal axis 10 of the shoe, whereas the two other slits 9 in the ball/toe region 1*c* extend rearward towards the heel region 1*a* under an acute angle to the longitudinal axis 10 of the shoe, starting from the inner edge of the sole in the ball region 1*c* up to the metatarsal region 1*b*.

As already discussed above, to avoid the exertion of pressure on the metatarsus in the region of the arch insole and the spherical segment-shaped or ellipsoid segment-shaped hollow body, a damping element, e.g. in the form of foam material, may be provided in the hollow body 4*c* according to a preferred embodiment of the invention. To secure the damping foam material in the hollow body, the top surface of the second insole 4 is provided with a thin covering of leather or a leather-like material, which, however, is not illustrated in detail in the drawings.

During running or walking, the sole body 1 of the shoe is set on the ground first in heel region 1*a*. Thereby, the foot 12 compresses the rear part in the heel region 1*a* of the foam insert 3 which has the relatively deep recess 3*b* formed in its underside. Then, the foot 12 is rolled off via the guide body provided in the metatarsal region 1*b*, for example, in the form of the ellipsoid segment-shaped hollow body 4*c*, in such a manner that, as the sole body hits the ground, the foot 12 presses the elastically deformable second insole downward in the front ball/toe region 1*c*. Thereby, again in the ball/toe region 1*c* where the shallow recess 3*c* is formed in the underside of the foam insert 3, the foam insert 3 is pressed with different degrees of strength, i.e. it is pressed somewhat stronger in the region of the big toe than in the region of the other four toes.

The above described rolling process from setting the shoe or the sole body 1 down in the rear heel region 1*a*, via the rolling of the foot 12 in the metatarsal region 1*b* via the physiologically important guide body which, in the embodiment described, takes the form of an ellipsoid segment-shaped hollow body 4*c*, to setting the front ball/toe region 1*c* down, especially the big toe, realizes a very soft, joint-friendly way of walking and thus a physiologically correct rolling motion.

Due to the underside of the hollow body 4*c*, provided e.g. in an ellipsoidal segment shape, integrated in the second insole 4, a physiologically correct posture is also achieved during walking and standing. At the same time, the muscles are activated in a natural manner, primarily addressing those muscles that the foot does not tilt vertically to the left or right side with respect to the walking motion. Thus, the wearer of the shoe is given an enhanced or positively influenced feeling of balance.

LIST OF REFERENCE NUMERALS

1 sole body (shoe)
1*a* heel region
1*b* metatarsal region
1*c* ball/toe region
2 first thin insole
2*a* arch insole of 2
2*b* recess in 2*a*
3 foam insert
3*a* cutout in 3
3*b* deep recess in 3
3*c* shallow recess in 3
4 second insole
4*c* spherical segment-shaped or ellipsoid segment-shaped hollow body
5 insert of 4
7 slit in the heel region of 4
8 slit in the ball/toe region of 4
9 slit in the ball/toe region of 4
10 longitudinal axis of the shoe
11 upper (shoe)
12 foot

The invention claimed is:

1. A shoe comprising:

a sole body extending from a heel region to a front ball/toe region via a metatarsal region, and an upper fastened to the sole body, wherein the following is provided on the sole body:

a) a first thin insole with an arch insole formed in the metatarsal region, the arch insole having a recess;

b) on the first insole, a foam insert extending continuously from the heel region to the front ball/toe region, the foam insert having a cut-out in the metatarsal region corresponding to the size of the arch insole, and c) on the foam insert, a second insole in the form of a foot bed having a spherical segment-shaped or ellipsoidal segment-shaped hollow body protruding from the underside of said second insole in the metatarsal region which correspondingly mates with the recess in the arch insole, whereby the spherical segment-shaped or ellipsoidal segment-shaped hollow body acts as a guide body for rolling off a foot and;

whereby the shoe is configured such that impact stresses occurring while walking or running are not, or are only to a very limited extent, transmitted to the knees, the hip joints and the vertebral column, and at the same time, a physiological correct rolling motion is achieved.

2. The shoe of claim 1, wherein the first insole with the arch insole and the second insole with the spherical segment-shaped or ellipsoidal segment-shaped hollow body are made from a wear-resistant, abrasion-resistant material.

3. The shoe of claim 2, wherein the wear-resistant, abrasion-resistant material is carbon fiber reinforced material, hard plastics, hard rubber, metal or a similar material with corresponding properties.

4. The shoe of claim 1, wherein in the heel region, the foam insert has a deep recess in the underside thereof and a shallow recess in the front ball/toe region.

5. The shoe of claim 4, wherein the foam insert is made from a resilient material.

6. The shoe of claim 1, wherein the heel region of the second insole is given a raised design corresponding to a spherical heel.

7. The shoe of claim 1, wherein a damping element is accommodated in the spherical segment-shaped or ellipsoidal segment-shaped hollow body.

8. The shoe of claim 7, wherein the damping element is foam material.

9. The shoe of claim 1, wherein in the heel region of the second insole, at least one slit is formed that extends frontward from the outer edge at an acute angle to the longitudinal axis of the shoe.

10. The shoe of claim 1, wherein in the ball/toe region of the second insole, at least one slit is formed that extends forward from the outer edge of the sole at an acute angle to the longitudinal axis of the shoe, and at least two slits are formed that extend rearward from the inner edge of the sole at an acute angle to the longitudinal axis of the shoe.

11. A shoe comprising:

a sole body extending from a heel region to a front ball/toe region via a metatarsal region, and an upper fastened to the sole body, wherein the following is provided on the sole body:

a) a first thin insole having a spherical segment-shaped or ellipsoidal segment-shaped hollow body protruding from the upper side of said insole in the metatarsal region;

b) on said first insole, a foam insert extending continuously from the heel region to the front ball/toe region, the foam insert having a cut-out in the metatarsal region corresponding to the size of said hollow body, and c) on said foam insert, a second insole in the form of a foot bed having an arch insole protruding from the underside of said second insole in the metatarsal region, the arch insole having a recess which correspondingly mates with said hollow body, wherein the arch insole acts as a guide body for rolling off of a foot and;

whereby the shoe is configured such that impact stresses occurring while walking or running are not, or are only to a very limited extent, transmitted to the knees, the hip joints and the vertebral column, and at the same time, a physiological correct rolling motion is achieved.

* * * * *